United States Patent [19]

Pankopf

[11] Patent Number: 4,710,978

[45] Date of Patent: Dec. 8, 1987

[54] PROTECTIVE GARMENT FOR WATER ACTIVITIES

[76] Inventor: Bradford Pankopf, 267 Nieto Ave., Long Beach, Calif. 90803

[21] Appl. No.: 885,893

[22] Filed: Jul. 14, 1986

[51] Int. Cl.[4] ..... A62B 17/00; A41B 7/00

[52] U.S. Cl. ..... 2/2.1 R; 2/123; 2/227

[58] Field of Search ..... 2/2.1 R, 123, 16, 22, 2/23, 125, 126, 227, 228, 231, 232, 225, 407; 36/2 R

[56] References Cited

U.S. PATENT DOCUMENTS

| | | | |
|---|---|---|---|
| 147,810 | 2/1874 | Baron | 36/2 R |
| D. 273,434 | 4/1984 | Galbreath | 2/227 |
| 751,741 | 2/1904 | Lyons | 2/231 |
| 2,203,401 | 6/1940 | Barnard | 2/407 |
| 2,981,954 | 5/1961 | Garbellano | 2/2.1 R |
| 3,082,764 | 3/1963 | Galanis | 2/125 X |

FOREIGN PATENT DOCUMENTS

| | | | |
|---|---|---|---|
| 1193383 | 5/1965 | Fed. Rep. of Germany | 2/2.1 R |

*Primary Examiner*—Louis K. Rimrodt

*Attorney, Agent, or Firm*—Nilsson, Robbins, Dalgarn, Berliner, Carson & Wurst

[57] ABSTRACT

A protective garment covering for the human body, formed of rubber-like material has a thickness of at least 3/32 of one inch and is provided with elongated terminations at the arm and leg cuffs. For ease of putting on and removing the garment, the orifices at the tubular arm and leg sections are elongated to accomplish an annular measurement substantially greater than the annular measurement of an actual cross section of the tubular section contiguous to the terminating cuff.

8 Claims, 5 Drawing Figures

PROTECTIVE GARMENT FOR WATER ACTIVITIES

BACKGROUND AND SUMMARY OF THE INVENTION

Rubber-like protective clothing has widespread use for various water sports. For example, protective garments in the form of wetsuits are variously constructed for warmth and protection in water activities. For example, such garments are used in surfing, diving, water skiing, and board sailing.

Generally, protective garments for water sports are made of rubber-like material having a substantial thickness. For example, closed cell neoprene is one form of rubber-like material which is in widespread use for wetsuits. Such material is protective and has a degree of elasticity to accommodate dressing in such a garment. In that regard, a snug fit is generally advisable not only for the effective retention of body heat but also to protect the wearer and allow him or her efficient movement in the water. Consequently, in spite of the resiliency of the material, donning and removing such protective garments normally involves inconvenient tugging and pulling to some extent. Generally, the greatest aggravation is encountered at sleeve and leg cuffs (terminations) where the garment terminates in a circular orifice.

Various closures including zippers have been proposed for use in protective water garments to facilitate donning and removing such garments. However, fasteners invariably present several complications. Specifically, they can snag or bind, and they increase fabrication costs. Consequently, fasteners are usually avoided if practical.

It has been proposed to make protective suits for water use of rubber-like material clad with a fabric. Generally, the addition of a fabric layer is helpful in sewing the garment together and also tends to render the garment more resistive to tearing. Accordingly, wetsuits have been provided with fabric layers on: the inside, the outside, and both sides of the suit. Fabric inside the suit may tend to ease the operation of donning and removing the suit. That is, the fabric interior may have less tendency to bind against the wearer's skin than the bare rubber-like material. However, the added fabric may tend to limit the elasticity of the rubber-like material with consequential difficulties. Specifically, drawing the cuffs (terminations) of suits made of such material over the hands and feet of the wearer tends to be difficult, particularly if the cuffs incorporate a hem or a section of increased thickness.

In general, the present invention comprises a protective garment for personal use in water activities which is formed of rubber-like material having a thickness of at least 3/32 of one inch. The covering may be clad on one or both sides with a fabric, e.g. nylon. The cuff terminations at the arms and legs (extremities) of the garment are provided to define an elongated orifice having an annulus measurement substantially greater than the cross section (cut) of the garment contiguous to the cuff. For example, tapered and arcuate cuff forms are disclosed herein to ease forcing a hand or foot through the orifice.

BRIEF DESCRIPTION OF THE DRAWINGS

In the drawings, which constitute a part of this specification, exemplary embodiments of the invention are set forth as follows.

DESCRIPTION OF THE ILLUSTRATIVE EMBODIMENTS

As indicated above, detailed illustrative embodiments of the present invention are disclosed herein. However, specific materials, shapes, and construction details structured in accordance with the present invention may be embodied in a wide variety of forms, some of which may be quite different from those of the disclosed embodiments. Consequently, the specific structural and functional details disclosed herein are merely descriptive; yet in that regard, they are deemed to afford the best embodiments for purposes of disclosure and to provide a basis for the claims herein which define the scope of the present invention.

Figure 1:
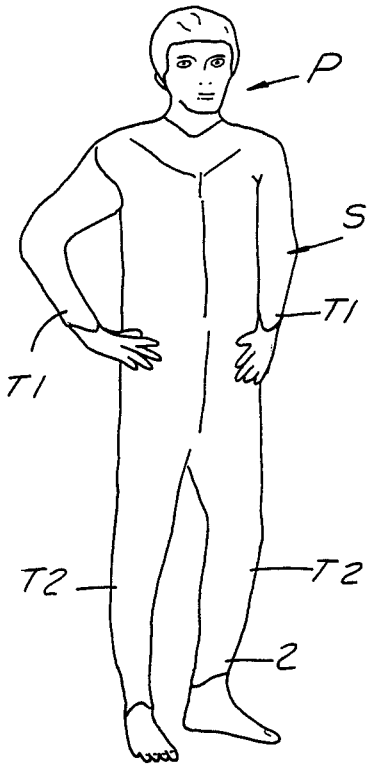
FIG. 1 is a perspective view of a water garment in accordance with the present invention.

Referring initially to FIG. 1, a protective suit S is illustrated being worn by a person P. The suit S may be a wetsuit and may be formed of a wide variety of different materials. However, the material in the suit has specific characteristics including a minimal thickness dimension and a degree of resiliency. Generally, the suit S comprises a rubber-like material having a thickness in excess of 3/32 of one inch. In the suit S of the illustrative embodiment, a specific material is disclosed which includes a thickness of neoprene that is relatively soft, lightweight, and flexible as a result of a closed-cell structure. Additionally, the material carries a lightweight nylon clad on the neoprene. Other cladding materials may, of course, be employed.

Figure 2:
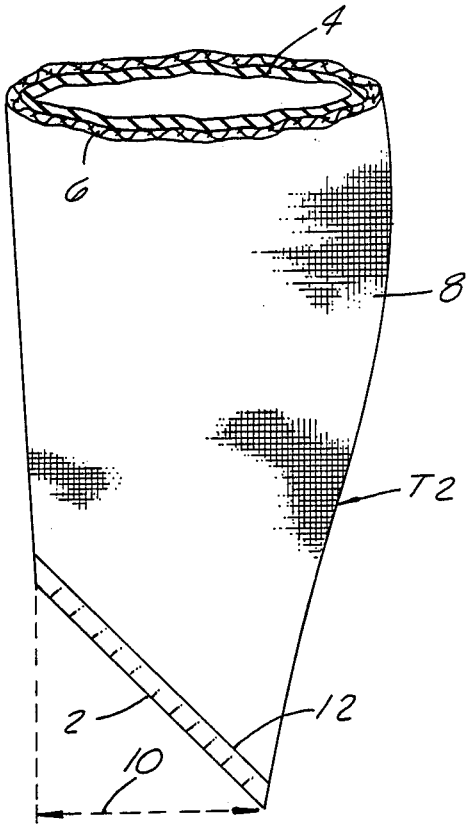
FIG. 2 is an enlarged sectioned side view of a leg portion of the garment of FIG. 1.
Figure 3:
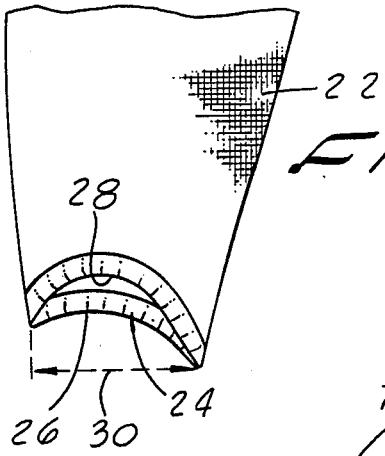
FIG. 3 is a view similar to FIG. 2 showing an alternative form of the garment.
Figure 5:
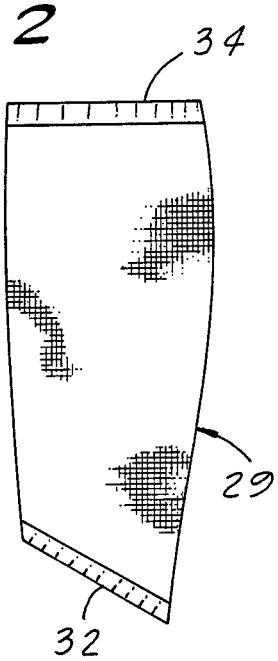
FIG. 5 is a side view of an alternative form of water garment in accordance with the present invention.
Figure 4:
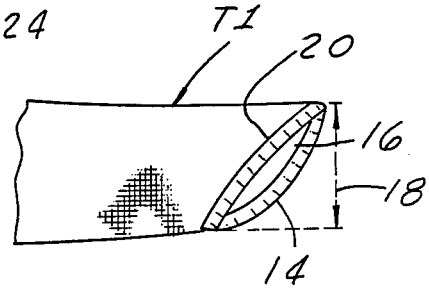
FIG. 4 is a fragmentary side view of a sleeve portion of the garment of FIG. 1.

The distinctions of the suit S reside in the terminations or cuffs at the ankles and wrists. Specifically, these terminations are configured in structural patterns which facilitate donning and removing the suit S. The details of the ankle terminations are illustrated in FIG. 2 while the details of the wrist terminations are illustrated in FIG. 4. FIGS. 3 and 5 illustrate alternative embodiments.

Generally, the extremity terminations of the suit S are located at the ends of tubes for enclosing an arm or leg. Specifically, tubular portions T1 enclose the arms while tubular portions T2 enclose the legs. Accordingly, each of the tubular portions T1 and T2 terminate at either a wrist or an ankle cuff. As disclosed in detail, the cuffs may be simply cuts of the tubular portions T1 and T2 or may be variously reinforced and otherwise formed. However, in accordance herewith the cuffs define orifices having an annular measurement that is substantially greater than the annulus measurement of a cross section taken through the tube at a location contiguous to the termination. Specifically, reference will now be made to FIG. 2 to consider details of the cuff termination 2 of the suit S.

Considering either of the leg tubes T2, it has a somewhat cylindrical configuration being formed with a thickness 4 of rubber-like material clad with a layer 6 of nylon fabric. As illustrated (FIG. 2), the tubular portion T2 defines somewhat of a bulge 8 to accommodate the human leg shape; however, the shape indicates a close fit to the person P. Removed from the person P, the tubular portion T2 will have a somewhat more cylindrical or tubular configuration the cross section of which is indicated by a dashed line 10 located contiguous to the cuff termination 2.

In accordance with the present invention, the termination 2 constitutes an orifice with an annular measurement substantially greater than the annular measurement that would be taken at the cross section as indicated by the dashed line 10. Consequently, the cuff termination 2 defines an orifice which is substantially greater than the orifice that would be defined cross sectionally through the tubular portion T2 taken at the dashed line 10.

The increased dimension of the orifice at the cuff termination 2 greatly facilitates the ease of donning and removing the suit S even when the termination 2 is double thickness. Specifically, the enlarged orifice, accomplished by an irregular cut through the substantially cylindrical tubular portion 2, facilitates pulling the tubular portion 2 over a foot of the person P. Note that the operation is facilitated either where the termination 2 is defined by a hem 12 of increased thickness, or in terminations which do not incorporate a hem 12.

A similar phenomenon to ease donning or removing a suit exists with regard to the ankle cuff at the terminations 14 (FIG. 4) for the tubular portions T1. That is, the illustrated termination 14 defines an elongated orifice 16 having an annular measurement substantially greater than the annulus measurement of a cross section of the tube T1 at a location contiguous to the termination 14. Referring to FIG. 4, the annular measurement of the orifice 16 is taken as the linear distance around the circular orifice 16 as illustrated. The relative cross sectional measurement is taken as the circumference of the cylindrical tube portion T1 at the location of the dashed line 18 which is contiguous to the termination 14. As in the case of the ankle termination 2 (FIG. 2, explained above) the wrist termination 14 incorporates a fold or cuff 20 for increased strength and resistance. Accordingly, passing the termination 14 over the hand is facilitated by the enlarged dimension of the orifice 16 which has been determined to be effective both with and without a cuff 20 of increased thickness.

In the construction of the suit S, conventional fabrication techniques may be employed. Specifically, sheet material as described above may be cut in accordance with predetermined patterns then fabricated into a suit S. Generally, as well known and widely practiced in the art, components of the suit may be assembled using either adhesive techniques or stitching. With regard to folded or turned hems or cuffs 12 (FIG. 2) and 20 (FIG. 4), the sheet material may be simply rolled internally of the tubular section to provide a double thickness then secured in such a position. Normally, a fold or double thickness of one inch or less is adequate and practical.

An important aspect of the present development lies in providing cuff terminations which define orifices of increased annular measurement or dimension. As illustrated in FIGS. 2 and 4, the increased dimension is accomplished by defining the terminations angularly offset from a plane perpendicular to the central axis of the tube or cylinder. In that regard, angular offsets of thirty or sixty degrees have been determined to be quite effective. However, other shapes also have been determined to be practical in accordance herewith.

Regarding alternative shapes for terminatiions, a leg tubular portion is illustrated in FIG. 3. A somewhat cylindrical leg tube 22 is terminated in a hem 24 configured to define a pair of parallel arcs 26 and 28 when the tube 22 is collapsed flat. Accordingly, the lip or orifice of the hem 24 has an annular measurement substantially greater than the annulus measurement at a cross section as indicated by a dashed line 30.

In view of the above embodiments, it will be apparent that various shapes of terminations may be employed to accomplish the desired orifice of increased dimension in accordance herewith. In that regard, it has generally been determined that an increase of at least twenty percent in the linear measurements is desirable to accomplish the objective of the present development.

In accordance with the present development, it is to be recognized that a form of protective garment may constitute far less than a full body suit. For example, a legging garment is illustrated in FIG. 5 which extends only from an ankle cuff 32 to a knee upper 34. Both the cuff 32 and the upper 34 are terminated in hems as explained above and additionally the cuff 32 is angularly cut to accomplish the increased dimension orifice.

Protective leggings as illustrated in FIG. 5 are useful in various water activities as water skiing. Generally, a particularly snug fit is necessary for such garments to remain in place, particularly during active wear as in skiing. In that regard, by providing the increased-dimension orifice of the present development, a snug fit may be accomplished yet the garment may be donned and removed with relative ease.

From the above descriptions it will be apparent that the present development may be variously embodied in a wide variety of protective garments using a wide variety of thick, resilient materials as well as a variety of terminations. Accordingly, the scope hereof is deemed to be appropriately determined in accordance with the claims as follow.

What is claimed is:

1. A protective garment for personal use as in water sport activities such as surfing, diving, water skiing and board sailing, said garment comprising:

a body covering formed of rubber-like sheet material having a thickness of at least three thirty-seconds of one inch, said covering including at least one tubular section for substantially containing a body extremity in snug-fit relationship, said tubular section terminating in an elongated orifice having an orifice annular measurement substantially greater than the annulus measurement of a cross section of said tube at a location contiguous to said terminating section whereby to accommodate putting on and removing said garment as a result of the greater annular measurement of said orifice.

2. A protective garment according to claim 1 wherein said elongated orifice comprises an increased thickness.

3. A protective garment according to claim 1 wherein said tubular section is fitted to receive an arm of a wearer with said elongated orifice at the wearer's wrist.

4. A protective garment according to claim 1 wherein said tubular section is fitted to receive a leg of a wearer with said elongated orifice at the wearer's ankle.

5. A protective garment according to claim 1 wherein said sheet material further includes a fabric layer.

6. A protective garment according to claim 1 wherein said elongated orifice comprises an increased thickness and wherein said sheet material further includes a fabric layer.

7. A protective garment according to claim 1 wherein said orifice is increased in annular measure by at least twenty percent.

8. A protective garment according to claim 1 wherein said elongated orifice is at an ankle or wrist termination.

* * * * *